US010046184B2

(12) United States Patent
Elliott et al.

(10) Patent No.: US 10,046,184 B2
(45) **Date of Patent: *Aug. 14, 2018**

(54) AIRCRAFT CREW MEMBER PROTECTIVE BREATHING APPARATUS

(71) Applicant: B/E Aerospace, Inc., Wellington, FL (US)

(72) Inventors: Andrew Elliott, Shawnee, KS (US); Girish Kshirsagar, Edmond, OK (US); Wayne Noehren, Olathe, KS (US); Chip Kuper, Lenexa, KS (US)

(73) Assignee: B/E Aerospace, Inc., Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/335,391

(22) Filed: Oct. 26, 2016

(65) Prior Publication Data

US 2017/0043192 A1 Feb. 16, 2017

Related U.S. Application Data

(63) Continuation of application No. 13/546,115, filed on Jul. 11, 2012, now Pat. No. 9,498,656.

(51) Int. Cl.
*A62B 7/00* (2006.01)
*A62B 18/04* (2006.01)
(Continued)

(52) U.S. Cl.
CPC ..... *A62B 18/04* (2013.01); *A62B 7/08* (2013.01); *A62B 9/006* (2013.01); *A62B 18/10* (2013.01)

(58) Field of Classification Search
CPC .. A62B 9/006; A62B 7/00; A62B 7/08; A62B 7/14; A62B 18/00; A62B 18/02;
(Continued)

(56) References Cited

U.S. PATENT DOCUMENTS 3,663,176 A 5/1972 Cagle et al.
3,709,663 A 1/1973 Hendricks
(Continued)

FOREIGN PATENT DOCUMENTS

CN 1551790 A 12/2004
CN 102451527 A 5/2012
(Continued)

OTHER PUBLICATIONS

MSA, MSDS003 Oxygen-Generating Canister, Material Data Sheet, Jun. 7, 2012, Rev. 5, p. 1.
(Continued)

*Primary Examiner* — Michael Tsai
(74) *Attorney, Agent, or Firm* — Donna P. Suchy

(57) ABSTRACT

A self-contained breathing device for use in fighting fires comprising a hood for covering a wearer's head, a membrane for sealing the hood to create a breathing chamber inside the hood, and a source of oxygen disposed inside the hood. The source of oxygen is connected to the user by a conduit inside of the hood, and another conduit directs user-exhaled carbon dioxide to the source of oxygen. The breathing device includes a visual indicator inside of the hood that reacts to the presence of a gas within the hood and provides visual feedback to the user based on a quantity of the gas present in the hood.

17 Claims, 4 Drawing Sheets

(51) Int. Cl.
*A62B 7/08* (2006.01)
*A62B 9/00* (2006.01)
*A62B 18/10* (2006.01)

(58) Field of Classification Search
CPC ..... A62B 18/025; A62B 18/04; A62B 18/045; A62B 18/088; A62B 21/00
See application file for complete search history.

(56) References Cited

U.S. PATENT DOCUMENTS

| | | | | |
|---|---|---|---|---|
| 3,762,407 | A | 10/1973 | Shonerd | |
| 3,773,044 | A | 11/1973 | Wallace | |
| 4,205,673 | A | 6/1980 | Wise et al. | |
| 4,326,514 | A | 4/1982 | Eian | |
| 4,503,850 | A | 3/1985 | Pasternak | |
| 4,614,186 | A | 9/1986 | John | |
| 4,728,499 | A | 3/1988 | Fehder et al. | |
| 4,754,751 | A | 7/1988 | Mausteller et al. | |
| 4,847,594 | A | 7/1989 | Stetter | |
| 5,003,973 | A | 4/1991 | Ford et al. | |
| 5,054,480 | A * | 10/1991 | Bare | A41D 13/11 128/201.25 |
| 5,119,808 | A | 6/1992 | Marquardt et al. | |
| 5,191,317 | A | 3/1993 | Toth et al. | |
| 5,198,147 | A | 3/1993 | Zhang et al. | |
| 5,297,544 | A | 3/1994 | May et al. | |
| 5,323,774 | A | 6/1994 | Fehlauer | |
| 5,326,531 | A | 7/1994 | Hahn et al. | |
| 5,447,688 | A | 9/1995 | Moore et al. | |
| 5,480,611 | A | 1/1996 | Mills et al. | |
| 5,495,847 | A | 3/1996 | Hu | |
| 5,601,078 | A | 2/1997 | Schaller et al. | |
| 5,613,488 | A | 3/1997 | Schwichtenberg | |
| 5,634,426 | A | 6/1997 | Tomlinson et al. | |
| 5,690,099 | A | 11/1997 | Abramov et al. | |
| 5,764,203 | A | 6/1998 | Holmlund et al. | |
| 5,857,460 | A | 1/1999 | Popitz | |
| 6,279,571 | B1 | 8/2001 | Meckes et al. | |
| 6,325,974 | B1 | 12/2001 | Ahvenainen et al. | |
| 6,338,822 | B1 | 1/2002 | Waldner et al. | |
| 6,443,149 | B1 | 9/2002 | Wise | |
| 6,467,333 | B2 | 10/2002 | Lewis et al. | |
| 6,497,756 | B1 | 12/2002 | Curado et al. | |
| 6,627,443 | B1 | 9/2003 | Stenholm et al. | |
| 6,995,665 | B2 | 2/2006 | Appelt et al. | |
| 7,089,930 | B2 | 8/2006 | Adams et al. | |
| 7,225,806 | B2 | 6/2007 | Mawhirt et al. | |
| 7,246,622 | B2 | 7/2007 | Geist | |
| 7,442,237 | B1 | 10/2008 | Gardner | |
| 7,503,962 | B2 | 3/2009 | Attar | |
| 7,921,798 | B2 | 4/2011 | Kodama et al. | |
| 8,067,110 | B2 | 11/2011 | Rakow et al. | |
| 8,222,041 | B2 | 7/2012 | Ren et al. | |
| 8,316,850 | B2 | 11/2012 | Grilliot et al. | |
| 8,365,723 | B2 | 2/2013 | Poirier et al. | |
| 8,454,526 | B2 | 6/2013 | Baker, Jr. et al. | |
| 9,027,557 | B2 | 5/2015 | Dussart et al. | |
| 2002/0092525 | A1 | 7/2002 | Rump et al. | |
| 2003/0045608 | A1 | 3/2003 | Ochiai et al. | |
| 2003/0105407 | A1 | 6/2003 | Pearce, Jr. et al. | |
| 2004/0065329 | A1 | 4/2004 | Geist | |
| 2006/0213523 | A1 * | 9/2006 | VanDerWoude | A41D 13/0025 128/863 |
| 2007/0062255 | A1 | 3/2007 | Talton | |
| 2011/0015599 | A1 | 1/2011 | Song et al. | |
| 2011/0244585 | A1 | 10/2011 | Mayne-L'Hermite et al. | |
| 2012/0028846 | A1 | 2/2012 | Yaghi et al. | |
| 2012/0111330 | A1 | 5/2012 | Gartner | |
| 2013/0010288 | A1 | 1/2013 | Dwyer et al. | |
| 2013/0014752 | A1 * | 1/2013 | Ausen | A62B 7/10 128/201.25 |
| 2013/0259749 | A1 | 10/2013 | Moretti et al. | |
| 2014/0014099 | A1 | 1/2014 | Elliott et al. | |
| 2014/0137870 | A1 | 5/2014 | Barlow et al. | |

FOREIGN PATENT DOCUMENTS

| | | |
|---|---|---|
| DE | 19650897 | 6/1998 |
| DE | 19832000 | 11/1999 |
| EP | 0 535 385 | 4/1993 |
| GB | 2 273 054 A | 6/1994 |
| GB | 2 273 054 B | 1/1997 |
| GB | 2394281 | 4/2004 |
| JP | 2004257930 | 9/2004 |
| JP | 2004257931 | 9/2004 |
| JP | 2007187644 | 7/2007 |
| JP | 2008056289 | 3/2008 |
| JP | 2008296971 | 12/2008 |
| WO | 9824516 | 6/1998 |

OTHER PUBLICATIONS

International Search Report, dated Nov. 20, 2014, 3 pages, from PCT/US2014/045986.
Office Action on Canadian Patent Application No. 2,917,650 dated May 23, 2018. 4 pages.

* cited by examiner $O_2$ Indicator Example shown at 64%

$CO_2$ Indicator Example shown at 3.5%

AIRCRAFT CREW MEMBER PROTECTIVE BREATHING APPARATUS

CROSS-REFERENCES TO RELATED APPLICATIONS

This application claims priority from U.S. application Ser. No. 13/546,115, filed Jul. 11, 2012 incorporated by reference in its entirety.

BACKGROUND

Oxygen masks are well known in the art as a tool for fighting fires in an enclosed structure. A portable oxygen mask that can provide a steady and controlled stream of oxygen while maintaining a weight that allows for freedom of movement is a necessity when fighting fire. This need is never more prevalent than in the confined and pressurized environment of an aircraft. An aircraft fire presents many additional dangers due to its pressurized compartments and the presence of oxygen in large quantities. Therefore, there is a need in the art for a reliable and compact oxygen mask that is light weight and well suited for all closed environments, and particularly those of an aircraft.

One difficulty with present masks, or protective breathing equipment ("PBE") as they are known, is that it is difficult or sometimes impossible to determine when the oxygen or carbon dioxide levers are approaching dangerous levels. Sometimes in the excitement of fighting a fire, the adrenaline will cause the user to extend the fire fighting activities until becoming light-headed or passing out, causing a significant danger to the user. Since it cannot be determined whether the unit is still operating correctly, the user in many cases must remove the mask and either replace it or recharge it before being able to return to fighting the fire. If there were a reliable way for the user to monitor the oxygen and carbon dioxide, this would also allow the PBE user to wear the unit longer.

In view of this difficulty, the new version of the FCC crewmember PBE regulation (TSO-C11a) requires "failure of the unit to operate or to cease operation must be more apparent to the user. This must be accomplished with aural and/or visual warning that also must activate at gas supply exhaustion." The present invention seeks to address this issue, thereby meeting this portion of the requirements of TSO-C116a.

U.S. Pat. No. 5,613,488 to Schwichtenberg et al. discloses a chemical oxygen generator breathing device that seeks to achieve a level of availability of oxygen and aims to optimize the consumption of oxygen. However, the Schwichtenberg device is complex, expensive, and only deals with oxygen.

SUMMARY OF THE INVENTION

The present invention is a safety breathing apparatus that is especially suited for use in an aircraft, and provides a source of oxygen for approximately fifteen minutes to the user and provides a simple indicator of the operability of the device. The present invention can be used by air crew in the event of an emergency to fight cabin fires and provides the user with oxygen for about 15 minutes. The present invention further provides an indicator to assure the user of the operating status of the PBE. The present invention employs a film that comprises an indicator for oxygen and/or carbon dioxide levels. This indicator film would be installed on the inside of the crew member's PBE. The indicator provides the user with an immediate visual determination of the oxygen and/or carbon dioxide levels.

DETAILED DESCRIPTION OF THE PREFERRED EMBODIMENTS

Figure 1:
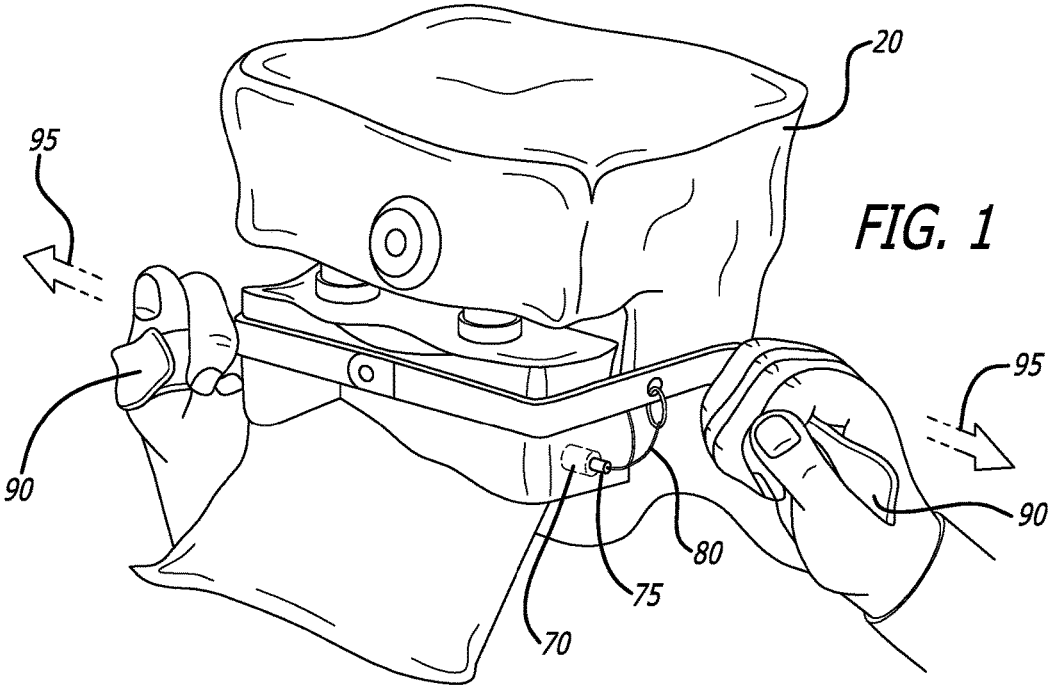
FIG. 1 is an elevated perspective view of a first preferred embodiment of the present invention.
Figure 2:
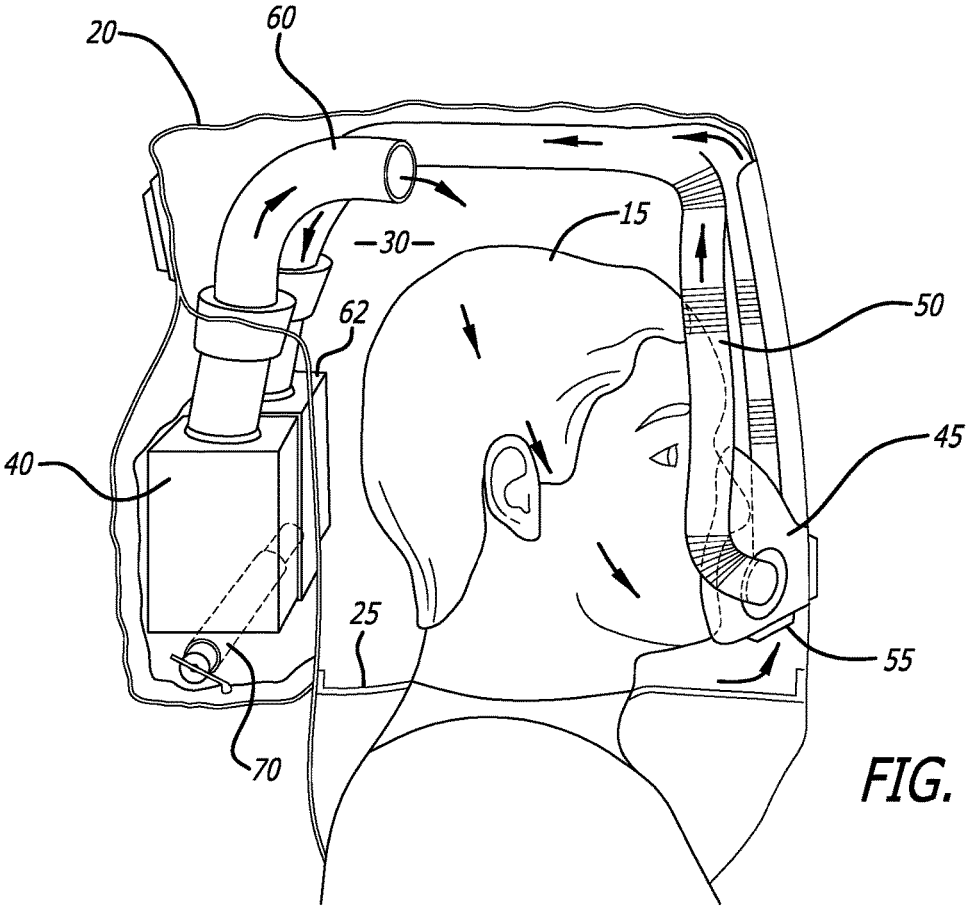
FIG. 2 is a side view, cut away, to show the airflow of the embodiment of FIG. 1.

The protective breathing equipment, or PBE, of the present invention is generally shown in FIGS. 1 and 2. A hood 20 is sized to fit over a human head 15, and includes a membrane 25 that the head 15 is slipped into and forms a seal to prevent gases or smoke from entering the breathing chamber 30. Behind the user's head 15 is an oxygen generating system 40 described in more detail below. An oronasal mouthpiece 45 allows oxygen to enter through a one-way inhalation valve 55, while carbon dioxide expelled from the user is routed back to the oxygen generating system 40 via an exhalation duct 50. Oxygen is produced in a chemical reaction and is communicated from the oxygen generating system 40 through an inhalation duct 60 to the mouthpiece 45 or the breathing chamber 30 generally.

During operation, the user exhales into the oronasal mouthpiece 45. The exhaled breath travels through the exhalation duct 50 and enters a canister 62 containing $KO_2$ (potassium superoxide). The exhaled carbon dioxide and water vapor are absorbed and replacement oxygen is released according to the reaction below:

Oxygen Generation: $2KO_2+H_2O \rightarrow 2KOH+1.5O_2$ $2KO_2+CO_2 \rightarrow K_2CO_3+1.5O_2$ Carbon Dioxide Removal: $2KOH+CO_2 \rightarrow K_2CO_3+H_2O$ $KOH+CO_2 \rightarrow KHCO_3$ The regenerated oxygen gas passes through the inhalation duct 60 and enters the main compartment, or breathing chamber 30, of the hood 20. The interior hood volume above the neck seal membrane 25 serves as the breathing chamber 30. When the user inhales, the one-way inhalation valve 55 allows the regenerated gas to enter the oronasal mouthpiece 45 and thus travel to the respiratory tract of the user. The breathing cycle will continue until the $KO_2$ canister 62 is exhausted.

According to the present invention, an indicator would be visible from inside the mask 20 that will provide a status of the oxygen and/or carbon dioxide levels within the PBE as the device is operating. Technology that evaluates the oxygen levels and carbon dioxide levels are known in the art. For example, oxygen indicators can be found in U.S. Pat. Nos. 6,325,974 and 4,504,522, as well as U.S Patent Publication No. 2005/037512. For carbon dioxide indicators, see U.S. Pat. Nos. 6,338,822 and 5,326,531, and U.S. Patent Publication No. 2003/045608A.

Figure 3:
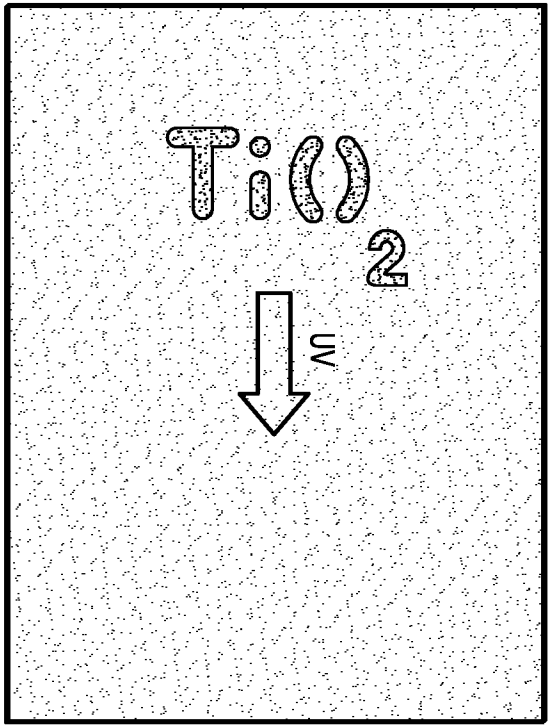
FIG. 3 is an example of a visual indicator showing the oxygen level inside the mask.
Figure 4A:
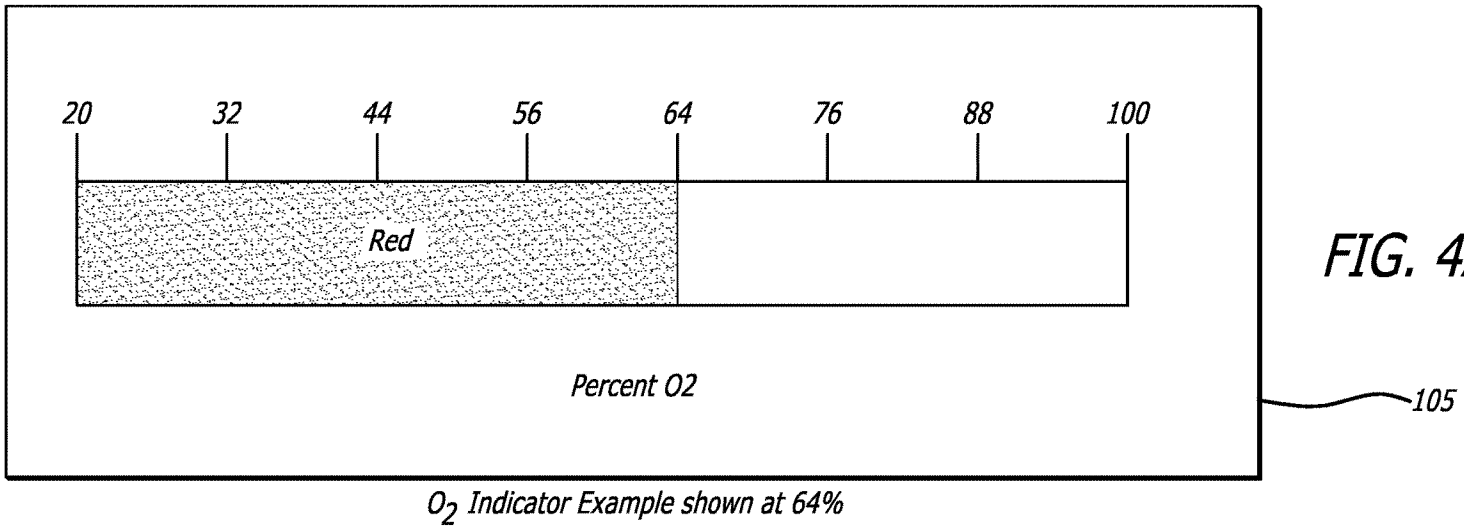
FIGS. 4*a* and 4*b* are alternate visual indicators for showing oxygen and CO2 levels inside the mask.
Figure 4B:
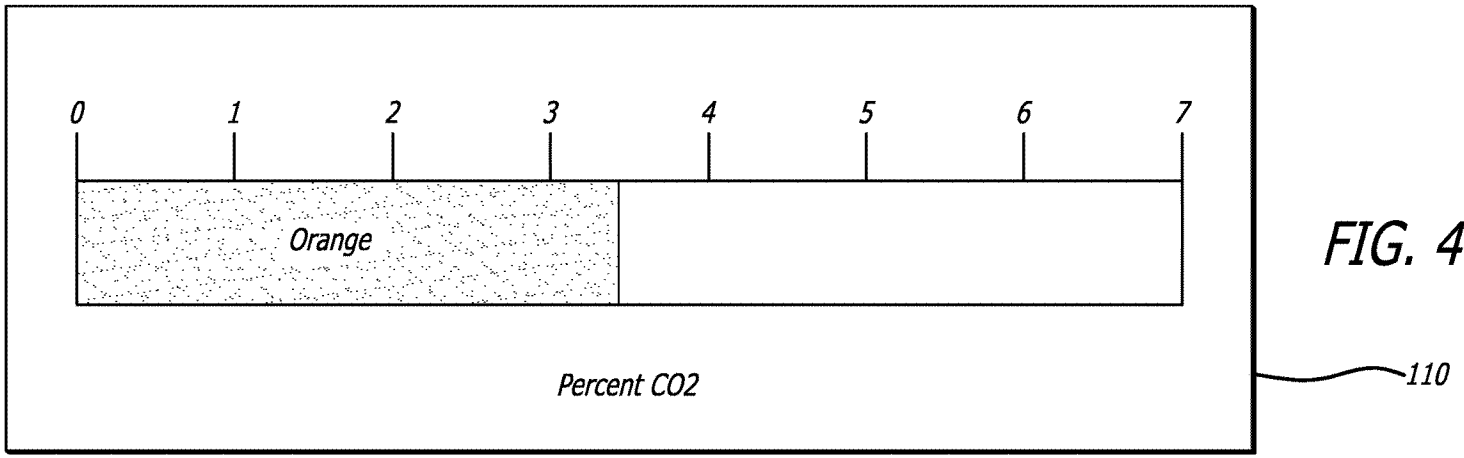
Figure 5:
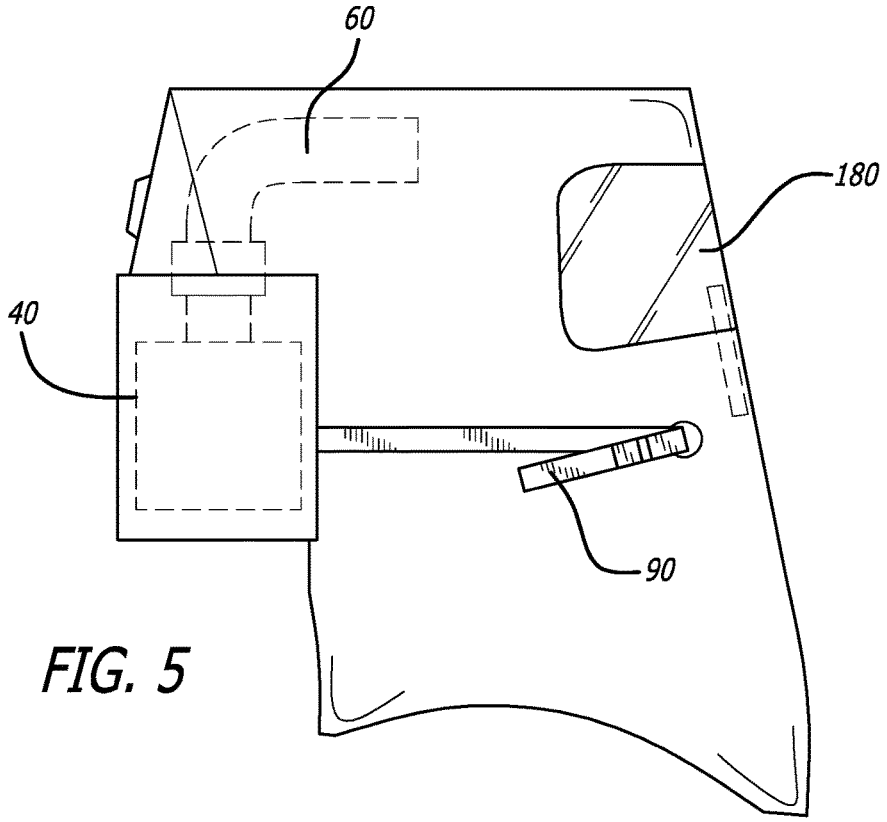
FIG. 5 is a side view showing the adjustment mechanism.
Figure 6:
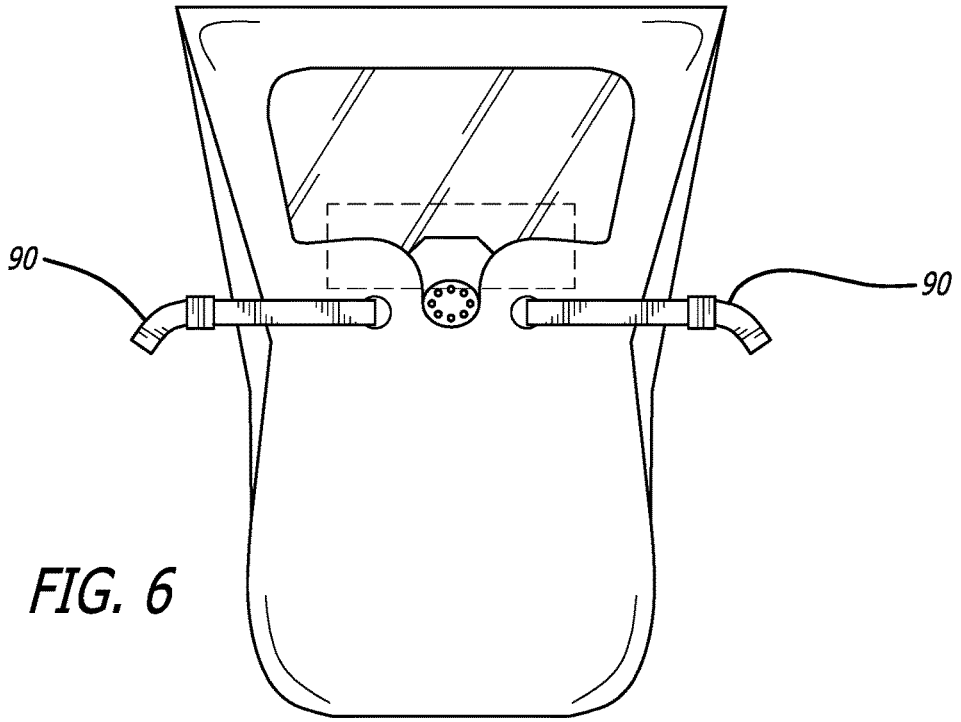
FIG. 6 is a front view of the present invention.

A gas sensitive ink or film may be adhered to the inside of a crew member PBE within the visible periphery of the user. In a preferred embodiment, there are two indicators inside the PBE. The first indicator detects the presence of oxygen (+30%), and rapidly changes color when a threshold value is reached or surpassed. The second indicator detects the presence of carbon dioxide (>4%) and also quickly turns from one color to another. Alternatively, the indicators can have words change color on the strips (i.e. "oxygen" or "remove hood"). The indicators thus provide the user with an immediate method to determine the oxygen and/or carbon dioxide levels without removing the apparatus. FIGS. 3 and 4 illustrate examples of visual indicators that can be used with the present invention.

For use on an aircraft, the PBE of the present invention is preferably vacuum sealed and stored at designated locations within the aircraft. The PBE can quickly be donned in the event of a cabin fire by air crew in order to combat the fire. The present invention is particularly well suited to protect the user from the hazards associated with toxic smoke, fire and hypoxia. The hood 20 has a visor 180 to protect the user's eyes and provides a means for continued breathing with a self-contained oxygen generating system 40. In a preferred embodiment, the system has a minimum of 15 minutes of operational life and is disposed of after use.

The PBE hood operation is described in more detail below. During the donning sequence, the user actuates a chlorate starter candle 70 by pulling the adjustment straps 90 in the direction indicated by arrows 95, thereby securing the oronasal mouthpiece 45 against the user's face. The chemical reaction of the starter candle 70 is shown below:

$$2NaClO_3+Heat \rightarrow 2NaCl+3O_2$$

The small chlorate candle 70 (starter candle) produces about 8 liters of oxygen by the chemical decomposition of sodium chlorate. This candle 70 is mounted to the bottom of the $KO_2$ canister 62. The starter candle 70 is preferably actuated by pulling a release pin 75 that is deployed automatically by a lanyard 80 when the user adjusts the straps 90 that tension the oronasal mouthpiece against the user's face. The gas of the starter candle 70 discharges into the $KO_2$ canister 62 on the side where exhaled breath enters the canister from the exhalation duct 50. Some of the oxygen from the starter candle 70 provides an initial fill of the exhalation duct, while the bulk of this oxygen travels through the $KO_2$ canister 62 and fills the main compartment 30 of the hood 20.

One of the challenges in current technology is lack of any indication regarding the remaining useful duration of the PBE after it has been activated. In addition, the operational duration is dependent upon workload performed by the user, which is dependent on the breathing rate. If the PBE is used to the point of its limit, then the ensuing collapse of the hood 20 can be uncomfortable at a minimum and frightening in a panic situation. The invention described herein allows the user to first know that the device is working as expected, and subsequently alert the user so she or he can retire to a safe zone to remove the device once gas levels become problematic. In addition, the new version of the FAA Crewmember PBE (TSO-C116a) requires "Failure of the unit to operate or to cease operation must be apparent to the user. This must be accomplished with aural and/or visual warning that also must activate at gas supply exhaustion." This device would meet the "exhausted of gas supply" requirements of TSO-C116a.

Intelligent, smart, or diagnostic inks respond to their environment by exhibiting a change in, for example, color or luminescence intensity. Specific environmental parameters can be monitored, such as temperature, humidity, oxygen concentration, and carbon dioxide concentration. The basic operating principle is that the compound used changes color in the presence and proportion of oxygen via the reduction oxidation (redox) mechanism. The range of materials used to do this is quite extensive, but only one specific type below is described for brevity.

The indicator may comprise an ink having a catalyzed thin film (nano particles) of a transition metal oxide, but alternatively may be formed by four more common constituents: an aqueous dispersion of a semiconductor ($TiO_2$), a sacrificial electron donor (triethanolamine), an aqueous solutions of a redox indicator dye (methylene blue), and an encapsulating polymer (hydroxyethylcellulose). The $TiO_2$ particles create electron-hole pairs when exposed to UV light. The electrons reduce the dye, causing it to be bleached, and the holes oxidize the triethanolamine. Polymer encapsulation allows the dye to be spin-coated onto plastic, metal, paper, or other surfaces. In one preferred embodiment, a solvent-based, irreversible oxygen indicator ink is used, comprising semiconductor photocatalyst nanoparticles, a solvent-soluble redox dye, mild reducing agent and polymer.

The ink loses its color rapidly (<30 s) upon exposure to the UVA light and remains colorless in an low oxygen concentration atmosphere, returning to its original color (blue) upon exposure to the appropriate concentration of oxygen. In the latter step, the rate of color recovery is proportional to the level of oxygen concentration. The film is reversible and can be returned to its white/clear color by UV activation.

As part of the present invention, the ink or film is designed to be an indicator that is adhered to the inside of a crew member PBE. In a preferred embodiment, there will be two indicators inside the PBE, one for oxygen 105 and one for carbon dioxide 110. Instead of the indicators just being a colored strip, it is possible to have text or a scale/spectrum color change on the strips. For example, the "text" shows the operation mode, and could even outline the scale for $CO_2$ and the scale for $O_2$ (See FIG. 4*a,b*). The scale would be produced as the levels change (i.e. more or less of the scale becomes colored). In this way, the wearer can tell something about the consumption of oxygen capacity. The benefit is that this invention provides the user with an immediate and continuous way to determine the status of the oxygen supply. It also allows the PBE user to wear the unit longer if needed because the oxygen generation of the assembly is continuously monitored. It further provides an immediate indication of an improperly fitted or damaged hood (leakage).

The exhaustion of the $KO_2$ canister 62 results in a loss of active oxygen generation capability, coupled with a rapid increase in internal temperature and release of moisture from the $KO_2$ canister. Previously, the loss of oxygen generating capability resulted in a gradual reduction of the interior volume of the hood 20. The hood 20 would need to collapse around the wearer's head 15; and as a result inhalation would become increasingly difficult, indicating that the hood 20 should be removed. The rapid rise in temperature inside the hood reinforced this indication. The present invention alleviates the subjective nature of determining the depletion of the oxygen generation chemicals because the user would have a visual indication of the amount of $O_2$ and $CO_2$ within the hood 20. This, in turn, will allow users to retire into a safe zone to remove the hood.

The present invention has been described in a general manner, but the foregoing description and included drawings are not intended to be limiting in any manner. One of ordinary skill in the art would envision many modifications and substitutions to the embodiments described herein, and the invention is intended to incorporate all such modifications and substitutions. Therefore, the scope of the invention is properly evaluated by the words of the claims appended hereto, and not strictly to any described embodiment or embodiment depicted in the drawings.

We claim:

1. A breathing apparatus comprising:

a hood and a self-contained oxygen source inside the hood, the self-contained oxygen source located behind a user's head;

a first tube connecting the self-contained oxygen source and terminating at a position above the user's head for delivering oxygen to a breathing area;

a second tube connecting a user's mouth piece to the self-contained oxygen source;

a transparent viewing window on the hood; and a first internal indicator on the transparent viewing window and facing the user inside the hood that indicates to the user that the self-contained oxygen source behind the user's head is providing a threshold oxygen level inside a breathing chamber at the breathing area.

2. The breathing apparatus of claim 1 wherein the self-contained oxygen source comprises a canister containing $KO_2$ (potassium superoxide) and a starter candle that activates a production of oxygen using $NaClO_3$.

3. The breathing apparatus of claim 1 wherein the first internal indicator automatically responds to a change in a level of oxygen via a chemical reaction that occurs on the first internal indicator.

4. The breathing apparatus of claim 1 wherein the self-contained oxygen source is initiated by a chlorate candle.

5. The breathing apparatus of claim 4 wherein the chlorate candle is actuated by pulling a pin.

6. The breathing apparatus of claim 5 wherein the pin is pulled automatically by adjusting the breathing device to the user.

7. The breathing apparatus of claim 1 wherein the first internal indicator is a thin film applied to an interior surface of the hood within view of the user.

8. The breathing apparatus of claim 7, wherein the thin film comprises a catalyzed thin film of metal oxide.

9. The breathing apparatus of claim 7, wherein the thin film comprises an aqueous dispersion of a semiconductor, a sacrificial electron donor, an aqueous solution of a redox-indicator dye, and an encapsulating polymer.

10. The breathing apparatus of claim 1, wherein the first internal indicator reacts to an oxygen level present in the hood to spell a word.

11. The breathing apparatus of claim 1, wherein the first internal indicator indicates a value on a scale corresponding to a concentration of gas inside the hood.

12. The breathing apparatus of claim 11, wherein said gas is oxygen.

13. The breathing apparatus of claim 11, wherein said gas is carbon dioxide.

14. The breathing apparatus of claim 1, wherein the first internal indicator is sensitive to ultraviolet light.

15. The breathing apparatus of claim 1, wherein the first internal indicator changes color as a result of a change in a concentration of a gas within the hood.

16. The breathing apparatus of claim 1, wherein the first internal indicator detects and visually displays a percentage of carbon dioxide in the hood.

17. The breathing apparatus of claim 1, wherein the first internal indicator detects and visually displays a percentage of oxygen in the hood.

* * * * *